United States Patent [19]

Stanko

[11] 4,098,257

[45] Jul. 4, 1978

[54] FIREPLACE SYSTEMS

[76] Inventor: John J. Stanko, 327 Coraopolis Rd., Coraopolis, Pa. 15108

[21] Appl. No.: 761,607

[22] Filed: Jan. 24, 1977

[51] Int. Cl.[2] ..... F24B 7/00

[52] U.S. Cl. ..... 126/121; 52/219

[58] Field of Search ..... 126/120, 121, 117; 237/55; 52/219

[56] References Cited

U.S. PATENT DOCUMENTS

| | | | |
|---|---|---|---|
| 649,251 | 5/1900 | Maude | 126/117 |
| 1,631,696 | 6/1927 | Robertson | 126/121 |
| 2,231,258 | 2/1941 | Elmore | 126/121 |
| 2,243,503 | 5/1941 | Frenette | 237/55 |
| 2,277,381 | 3/1942 | Black | 126/121 |
| 2,470,430 | 5/1949 | Carter | 126/120 |

*Primary Examiner*—Ronald C. Capossela
*Attorney, Agent, or Firm*—Buell, Blenko & Ziesenheim

[57] ABSTRACT

A fireplace heating system is provided having a fireplace box having a fireplace opening therein, a heat chamber surrounding said box, a plurality of spaced generally vertically extending flues connected to said fireplace box and holding said box suspended generally centrally of said heat chamber, said flues being adapted to carry the exhaust gases from the fireplace box, a hot air distribution duct connected to said heat chamber and surrounding the said flues over a portion of their length, said distribution duct having discharge vent means into the room being heated, a pre-heat chamber spaced from the heat chamber and the hot air distribution duct and surrounding said flues over a second portion of their length, a cold air inlet connected to said pre-heat chamber, a blower connected to said pre-heat chamber on the side of the pre-heat chamber opposite the cold air inlet receiving preheated air passing around the second portion of said flues from said pre-heat chamber for delivery to the heat chamber and chimney means connected to said flues receiving exhaust gases therefrom.

10 Claims, 6 Drawing Figures

FIREPLACE SYSTEMS

This invention relates to fireplace systems and particularly to a fireplace system designed to provide efficient recovery of the heat from the fireplace and distribute it into the room in which the fireplace is located.

Fireplaces have been used for centuries as a source of heat, however, they are notoriously inefficient in recovering the heat being generated for any useful purpose, the vast bulk of the heat going up the flue or stack and being lost to the atmosphere. In recent years, fireplaces have been, in general, considered decorative rather than functional so far as heat is concerned. More recently, with fuel shortages and heating costs rising there has been an upsurge in efforts to make the fireplace a source of emergency heating of greater efficiency. As a result, there have been numerous proposals for recovering a greater part of the heat lost through the stack. Typical of these developments are those illustrated in Sutton U.S. Pat. Nos. 3,175,552, Miller 3,930,491, Lassy 3,930,490, Nelson 3,896,785, Abshear 3,880,141 and Jones 3,866,595. While these systems undoubtedly increase the efficiency of a fireplace, they do not extract the maximum heat from the fuel.

The present invention provides a fireplace with all the desired aesthetic character of an open fireplace and with a very high recovery of heat. It provides a degree of efficiency of heat recovery greater than heretofore available in fireplace structures without the loss of any of the aesthetic quality of the fireplace.

The invention provides an open fireplace box, a heat chamber surrounding said box, a plurality of spaced generally vertically extending flues connected to said fireplace box and holding the said box suspended generally centrally of said heat chamber, said flues being adapted to carry the exhaust gases from the fireplace box, a hot air distribution duct connected to said heat chamber and surrounding the said flues over a portion of their length and having discharge vents into the room being heated, a pre-heat chamber spaced from the heat chamber and the hot air distribution duct and surrounding said flues over a second portion of their length, a cold air inlet connected to said preheat chamber, a blower connected to said pre-heat chamber on a side opposite the cold air inlet receiving preheated air from said pre-heat chamber for delivery to the heat chamber and a chimney connected to said flues receiving exhaust gases therefrom. The cold air inlet is preferably outside the room being heated for introducing external air. Preferably there are also provided return cold air ducts for returning cold air from the room being heated to the blower for recirculation through the heat chamber.

Preferably the firebox is made of corrugated metal to provide a larger area for heat exchange. A damper is preferably inserted between the preheat chamber and the mixing chamber to regulate the proportion of cold fresh air from the outside. The injection of fresh air from outside the room being heated mixed with recirculated air provides a positive pressure in the room which prevents drafts at windows and doors, as well as providing oxygen to be consumed in the fire in the firebox and the exhaust gases going up the chimney. The firebox may be set on an ash-pit down pipe for additional support as well as making it cleaner to handle the ashes. It is also possible to increase the efficiency of the fire to some degree by providing a valved connection from the blower to the firebox to increase burning and create a hotter fire in the firebox.

In the foregoing general description, I have set out certain objects, purposes and advantages of my invention. Other objects, purposes and advantages of my invention will be apparent from a consideration of the following description and the accompanying drawings in which, FIG. 1 is a front elevational view of the fireplace assembly of my invention;

Figure 1:
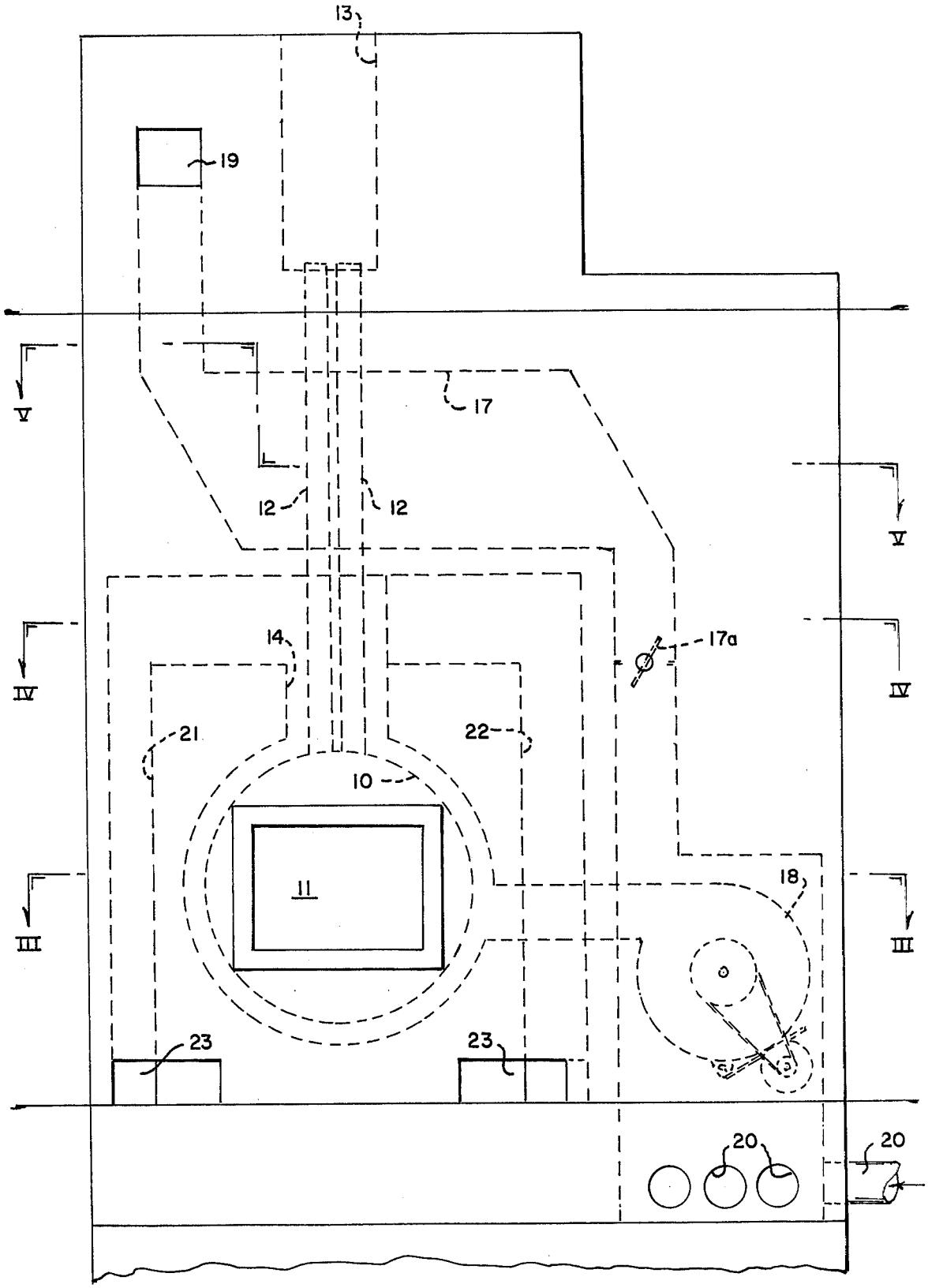
Figure 2:
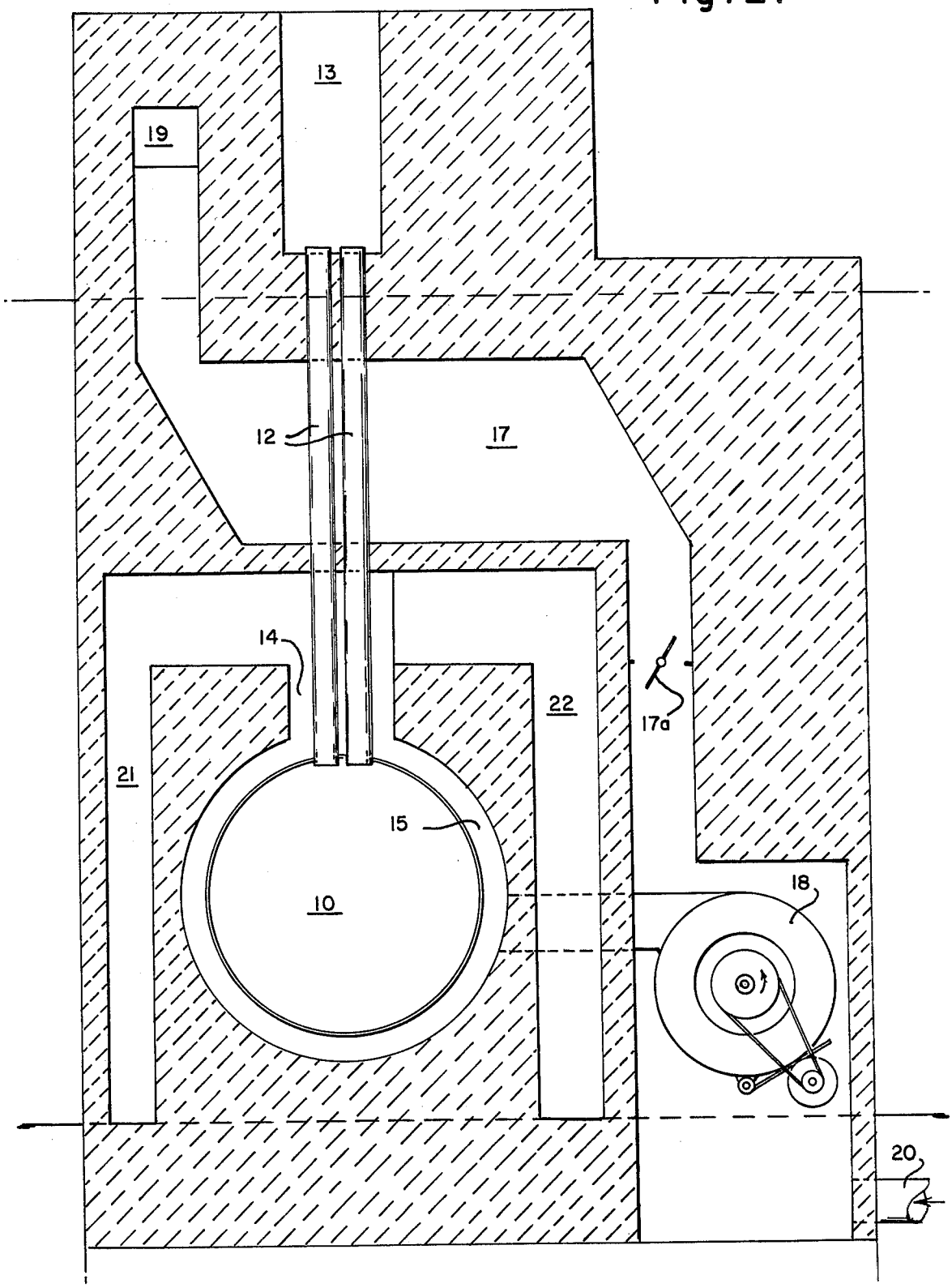
FIG. 2 is a vertical section through the assembly of FIG. 1.
Figure 3:
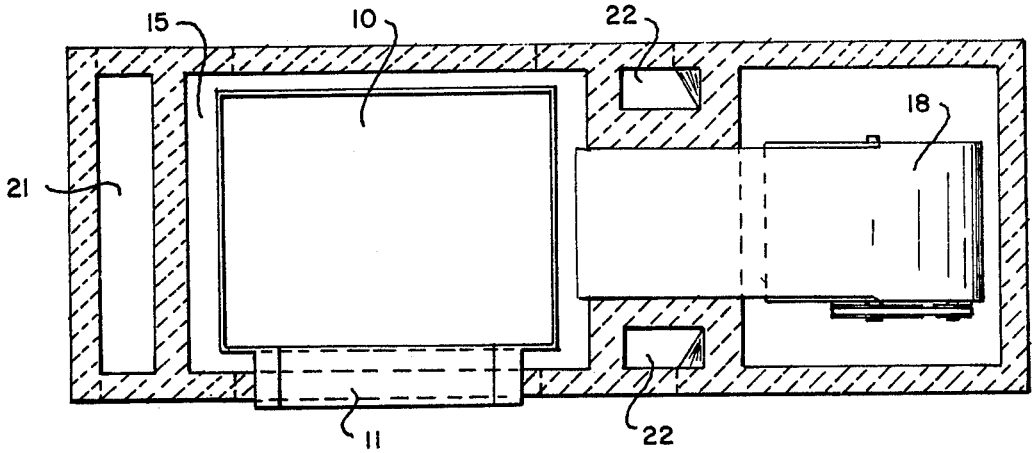
FIG. 3 is a section on the line III—III of FIG. 1.
Figure 4:
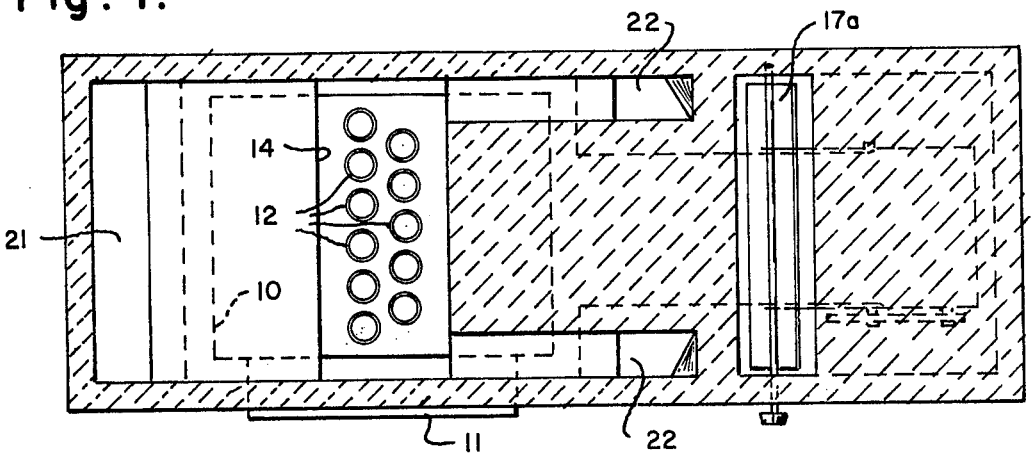
FIG. 4 is a section on the line IV—IV of FIG. 1.
Figure 5:
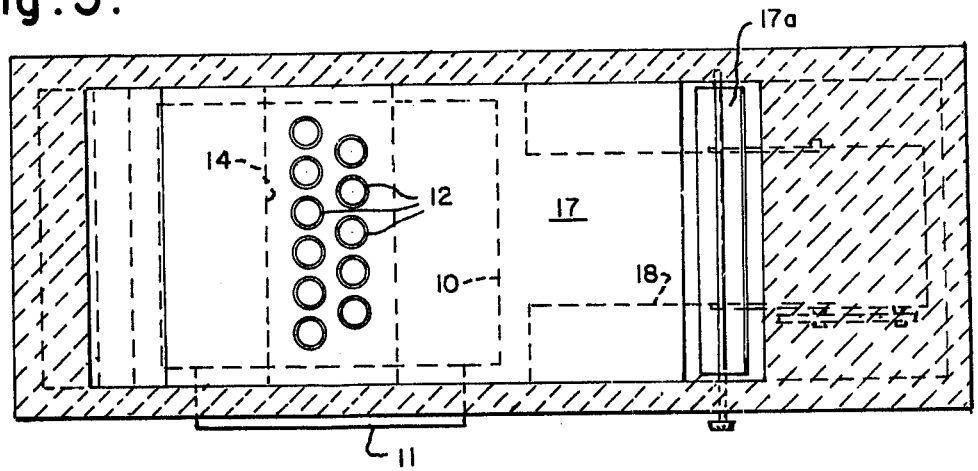
FIG. 5 is a section on the line V—V of FIG. 1.

Referring to the drawings, I have illustrated a firebox chamber 10, preferably of corrugated metal having a fireplace opening 11 suspended by a plurality of flues 12, preferably of metal, from the main chimney flue 13. The flues 12 extend vertically through passage 14 from heat chamber 15, through base 16 of pre-heat chamber 17 and through the pre-heat chamber 17 to chimney flue 13. The heat chamber 15 surrounds the firebox chamber 10 and is connected to blower 18 which draws air through damper **17*a* from cold air intake 19 through pre-heat chamber 17 where the air passes around flues 12 to extract heat from the flues 12. The blower 18 also draws air from return ducts 20. The air from blower 18 is circulated around firebox chamber 10 where it picks up heat from the firebox chamber walls, then around flues 12 in passage 14 and is carried through passages 21 and 22 and discharged through discharge outlets 23 into the room being heated. The room being heated thus receives heat from the fireplace opening 11 and from discharge outlets 23. The air passing through the preheat chamber 17 passes through the plurality of flues 12 and thus has the opportunity to extract the last amount of heat from the flue gases, while the heated air from blower 18 passing up through passage 14 pass around flues 12** before they enter the pre-heat chamber and is raised to maximum temperature by heat exchange with the flues.

Figure 6:
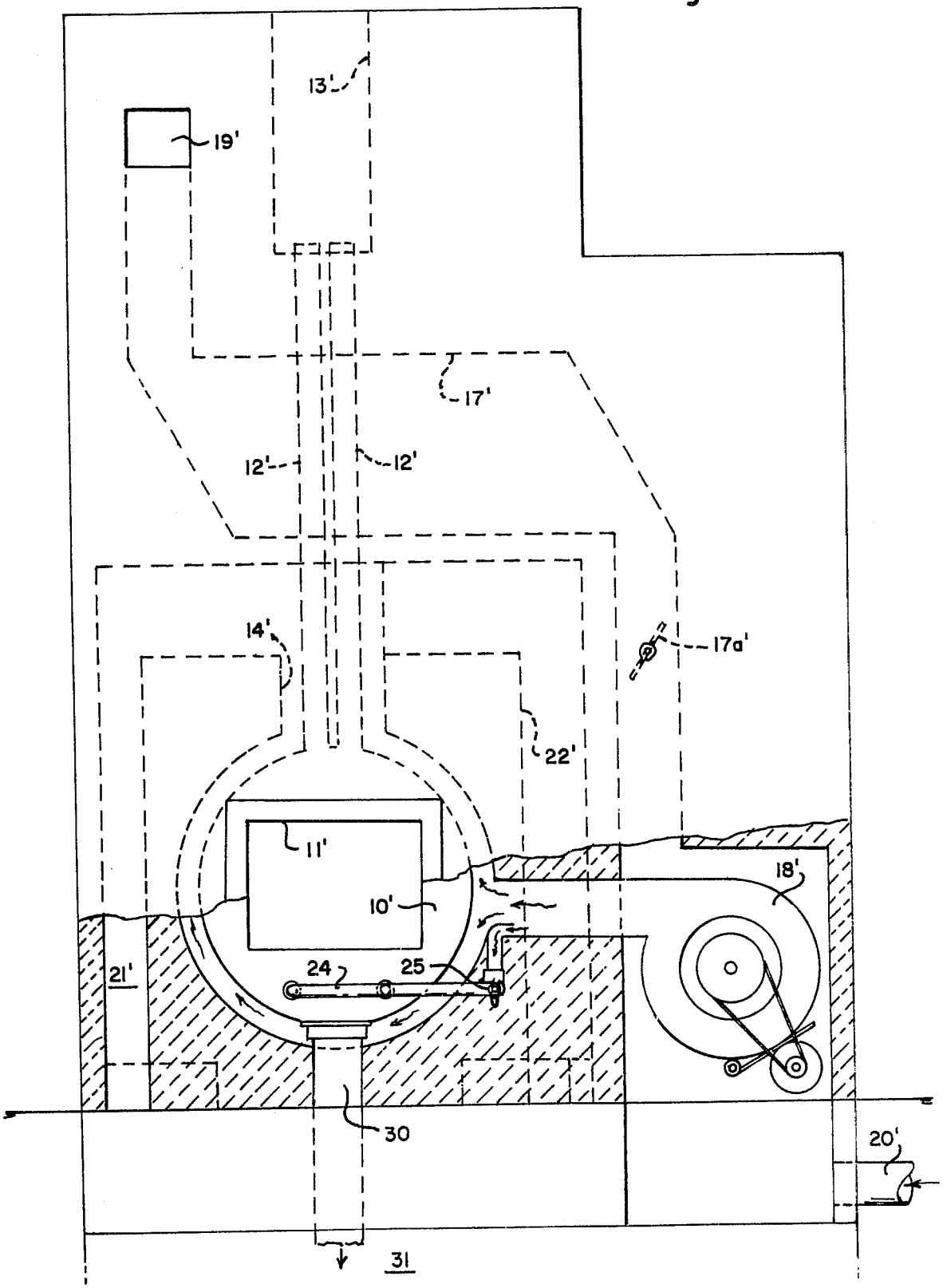
FIG. 6 is a front elevational view, partly in section, of a second embodiment of my invention.

In the embodiment of FIG. 6, all parts are the same as those of FIGS. 1 through 5 and carry like numbers with a prime suffix. The only difference is the inclusion of an ash drop pipe 30 from the firebox chamber 10 through the heat chamber and masonry base to a collection chamber 31 below the floor, e.g., in the basement. This aids in supporting the firebox chamber as well as providing a convenient discharge for the ashes.

A bypass line 24 from blower 18 goes to the bottom of firebox 10 whereby air, controlled by valve 25, can be introduced under pressure into the fire, making it hotter.

In the foregoing specification, I have set out certain preferred embodiments and practices of my invention, however, it will be understood that this invention may be otherwise embodied within the scope of the following claims.

I claim:

1. A fireplace heating system comprising a fireplace box having a fireplace opening therein, a heat chamber surrounding said box, a plurality of spaced generally vertically extending flues connected to said fireplace box and holding said box suspended generally centrally of said heat chamber and spaced from the walls of said heat chamber, said flues being adapted to carry the exhaust gases from the fireplace box, a hot air distribution duct connected to said heat chamber and surrounding the said flues over a portion of their length, said distribution duct having discharge vent means into the room being heated, a pre-heat chamber spaced from the heat chamber and the hot air distribution duct and surrounding said flues over a second portion of their length, a cold air inlet connected to said pre-heat chamber, a blower connected to said pre-heat chamber on the side of the pre-heat chamber opposite the cold air inlet receiving pre-heated air passing around the second portion of said flues from said pre-heat chamber for delivery to the heat chamber and chimney means connected to said flues receiving exhaust gases therefrom and supporting said flues and fireplace box.

2. A fireplace heating system as claimed in claim 1 wherein the cold air inlet means is outside the room being heated.

3. A fireplace heating system as claimed in claim 1 wherein return air ducts are connected to the blower for returning cold air from the room being heated to the heat chamber.

4. A fireplace heating system as claimed in claim 1 wherein the fireplace box is generally cylindrical in shape and the fireplace opening is generally rectangular in shape.

5. A fireplace heating system as claimed in claim 1 wherein the heat chamber is generally cylindrical in shape and is connected to a generally rectangular hot air distribution duct.

6. A fireplace heating system as claimed in claim 1 wherein the hot air distribution duct has discharge openings on opposite sides of the heat chamber adjacent the floor of the room being heated.

7. A fireplace heating system as claimed in claim 1 wherein the firebox chamber is of corrugated metal.

8. A fireplace heating system as claimed in claim 1 having a damper between the preheat chamber and blower.

9. A fireplace heating system as claimed in claim 1 having an ash discharge pipe open at its top to the firebox chamber and passing through the heating chamber to aid in supporting the firebox chamber.

10. A fireplace heating system as claimed in claim 1 wherein a bypass line connects the blower to the firebox chamber adjacent its bottom and valve means in said bypass line delivers air to the firebox chamber for improved combustion.

* * * * *